US006508691B1

(12) United States Patent
Liu

(10) Patent No.: US 6,508,691 B1
(45) Date of Patent: Jan. 21, 2003

(54) BUILT-UP SPINNING TOP

(76) Inventor: Kuo-Ching Liu, 5Fl., No. 11, Alley 1, Lane 1, Sec. 1, Yungans.Rd., Lujou City, Taipei 247 (TW)

( * ) Notice: Subject to any disclaimer, the term of this patent is extended or adjusted under 35 U.S.C. 154(b) by 0 days.

(21) Appl. No.: 10/173,406

(22) Filed: Jun. 18, 2002

(51) Int. Cl.[7] ..... A63H 33/00

(52) U.S. Cl. ..... 446/487; 446/97; 446/330; 446/385

(58) Field of Search ..... 446/85, 97, 102, 446/108, 109, 124, 80, 246, 266, 269, 279, 280, 281, 288, 330, 332, 335, 336, 385, 388, 487, 488; 273/156; 434/259

(56) References Cited

U.S. PATENT DOCUMENTS 2,874,513 A * 5/1959 Connell ..... 40/415
3,108,398 A * 10/1963 Einfalt ..... 104/60
3,969,841 A * 7/1976 Joseph ..... 446/335
5,403,223 A * 4/1995 Gaulkin et al. ..... 446/219

* cited by examiner

*Primary Examiner*—Jacob K. Ackun
*Assistant Examiner*—Bena B. Miller
(74) *Attorney, Agent, or Firm*—Rosenberg, Klein & Lee

(57) ABSTRACT

A built-up spinning top includes a turning wheel detachably connected to a fixing plate at a long opening thereof. The long opening has teeth provided along an inner edge thereof to mesh with a tooth gear of the turning wheel. An actuating handle is provided to detachably engage with a disc located at a bottom of the turning wheel, in order to move the turning wheel along the long opening. The meshing of the tooth gear with the teeth on the long opening brings the turning wheel to rotate while being moved along the long opening. Whereby when the spinning top is moved beyond the long opening to separate from the fixing plate, it keeps spinning on a plane surface just like a general spinning top. A user can effortlessly turn the built-up spinning top with the actuating handle to create a lot of fun.

3 Claims, 5 Drawing Sheets

BUILT-UP SPINNING TOP

FIELD OF THE INVENTION

The present invention relates to a built-up spinning top, and more particularly to a built-up spinning top having a turning wheel detachably connected to a fixing plate at a long opening thereof with a tooth gear coaxially connected to the turning wheel meshing with teeth provided on the long opening, such that the turning wheel rotates when it is moved along the long opening with an actuating handle and keeps spinning on its axial shaft on a plane surface when it is moved beyond the long opening to separate from the fixing plate.

BACKGROUND OF THE INVENTION

A conventional small spinning top usually includes a substantially conic spinning body. A grip bar is provided at a top of the conic spinning body for a user to grip thereat. To play the spinning top, the user has to hold the grip bar with three fingers to turn the grip bar in a certain direction. When the grip bar is released, the conic body would spin on its axis on a plane surface to create fun.

Since turning of the conventional spinning top with fingers requires exertion of efforts, the user might not be able to always successfully turn the spinning top as quickly as before after playing the same for a prolonged time. This largely reduces the fun that could be created from the spinning top.

SUMMARY OF THE INVENTION

A primary object of the present invention is to provide a built-up spinning top that can be effortlessly turned to create a lot of fun.

To achieve the above and other objects, the built-up spinning top of the present invention mainly includes a fixing plate, a turning wheel, and an actuating handle.

The fixing plate is provided with a long opening having an open end. The long opening is provided along an inner edge with a row of continuously arranged teeth.

The turning wheel includes an axially extended supporting shaft, a tooth gear fixed to a position near a middle point of the supporting shaft, an upper and a lower catch plates connected to the supporting shaft to separately locate above and below said tooth gear with a space between them slightly larger than a thickness of the fixing plate, and a handle-engaging disc formed from a plurality of laminated sub-discs and connected to the supporting shaft to locate below the lower catch plate.

The actuating handle has an end provided with a curved recess. The curved recess has openness slightly larger than the handle-engaging disc for freely detachably engaging with one side of the handle-engaging disc at any time.

The turning wheel is connected to the fixing plate at the long opening with the tooth gear meshing with the teeth on the long opening and the upper and the lower catch plates located above and below the fixing plate, respectively.

When the actuating handle is extended below the fixing plate to engage the end having the curved recess with one side of the handle-engaging disc of the turning wheel, the turning wheel can be moved back and forth along the long opening and rotates at the same time due to meshing of the tooth gear with the teeth on the long opening. And, the turning wheel keeps revolving about the supporting shaft on a plane surface when it is moved beyond the open end of the long opening to separate from the fixing plate.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
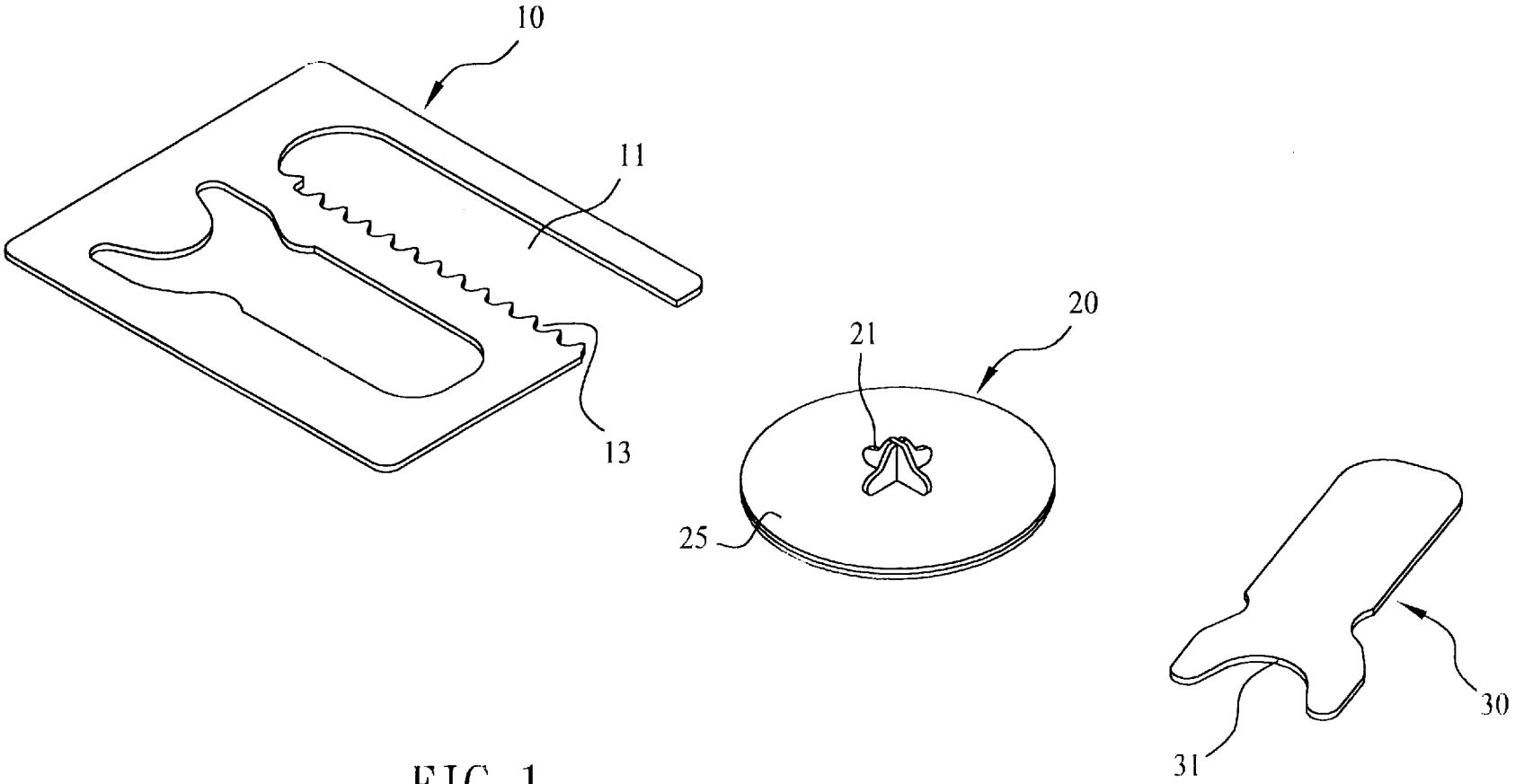
FIG. 1 is an exploded perspective view of a built-up spinning top according to an embodiment of the present invention.

Please refer to FIG. 1 that is an exploded perspective view of a built-up spinning top according to an embodiment of the present invention. As shown, the built-up spinning top mainly includes a fixing plate 10, a turning wheel 20, and an actuating handle 30.

The fixing plate 10 is provided with a long opening 11 having an open end. A longitudinal inner edge of the long opening 11 is provided with a row of continuously arranged teeth 13. The actuating handle 30 is provided at an end with a curved recess 31.

Figure 2:
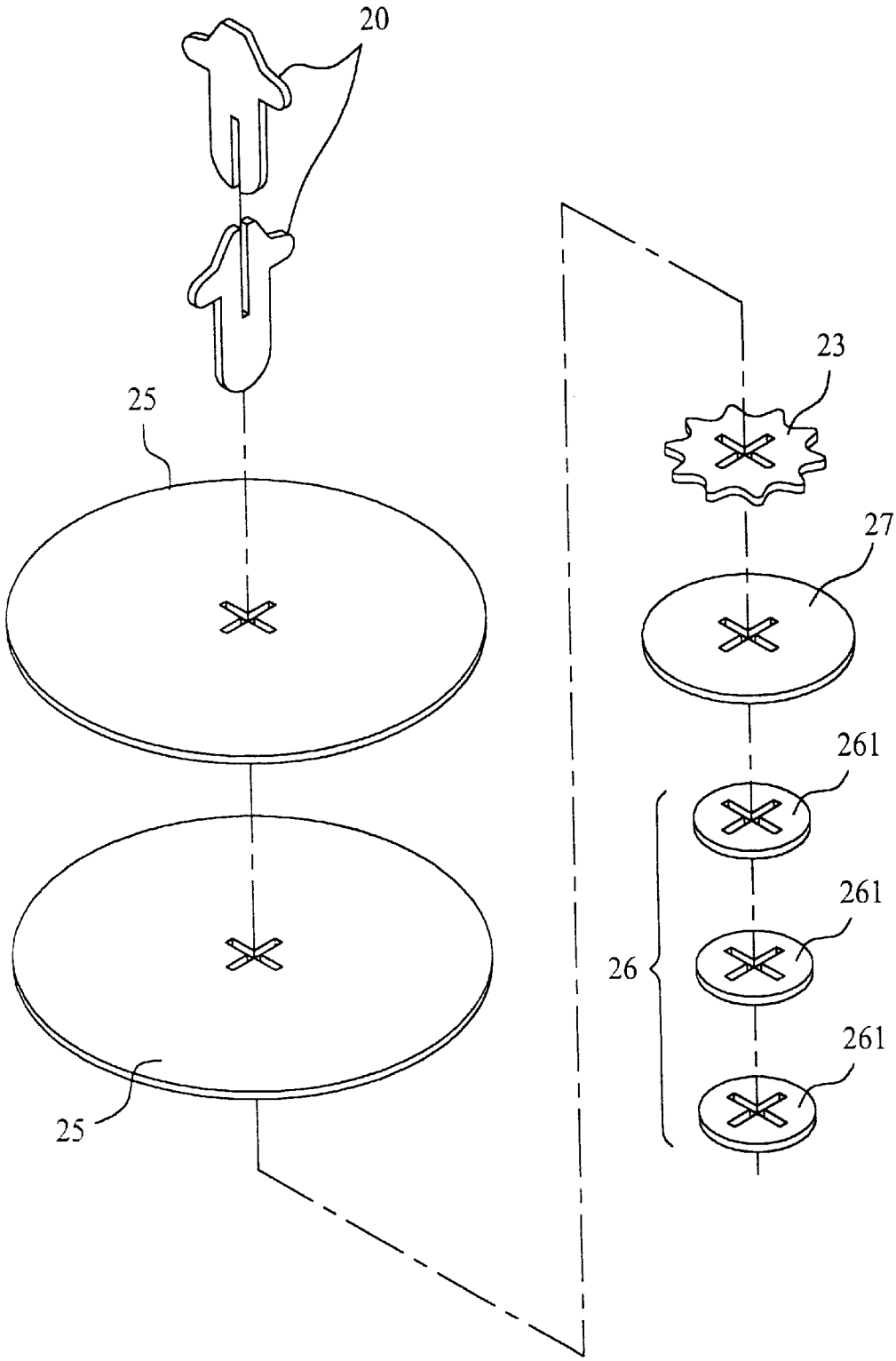
FIG. 2 is an exploded perspective view of a turning wheel included in the built-up spinning top of FIG. 1.

Please refer to FIG. 2 that is an exploded perspective view of the turning wheel 20. As shown, the turning wheel 20 mainly includes an axially extended supporting shaft 21 formed from two vertically intersected flat parts having predetermined shapes, a tooth gear 23 fixed to a position near a middle point of the supporting shaft 21, an upper catch plate 25 formed from two laminated round flat parts and connected to the supporting shaft 21 to locate above the tooth gear 23, a lower catch plate 27 smaller than the upper catch plate 25, connected to the supporting shaft 21 to locate below the tooth gear 23, and spaced from the upper catch plates 25 by a distance slightly larger than a thickness of the fixing plate 10, and a handle-engaging disc 26 connected to the supporting shaft 21 and located below the lower catch plate 27. The handle-engaging disc 26 is formed from a plurality of laminated sub-discs 261 and provides a center of gravity for the turning wheel 20 to spin stably. The handle-engaging disc 26 of the turning wheel 20 is so dimensioned that it is slightly smaller than openness of the curved recess 31 of the actuating handle 30, so that the actuating handle 30 may be freely engaged with and disengaged from one side of the handle-engaging disc 26 at any time. The tooth gear 23 is designed to mesh with the teeth 13 provided in the long opening 11 on the fixing plate 10.

Figure 3:
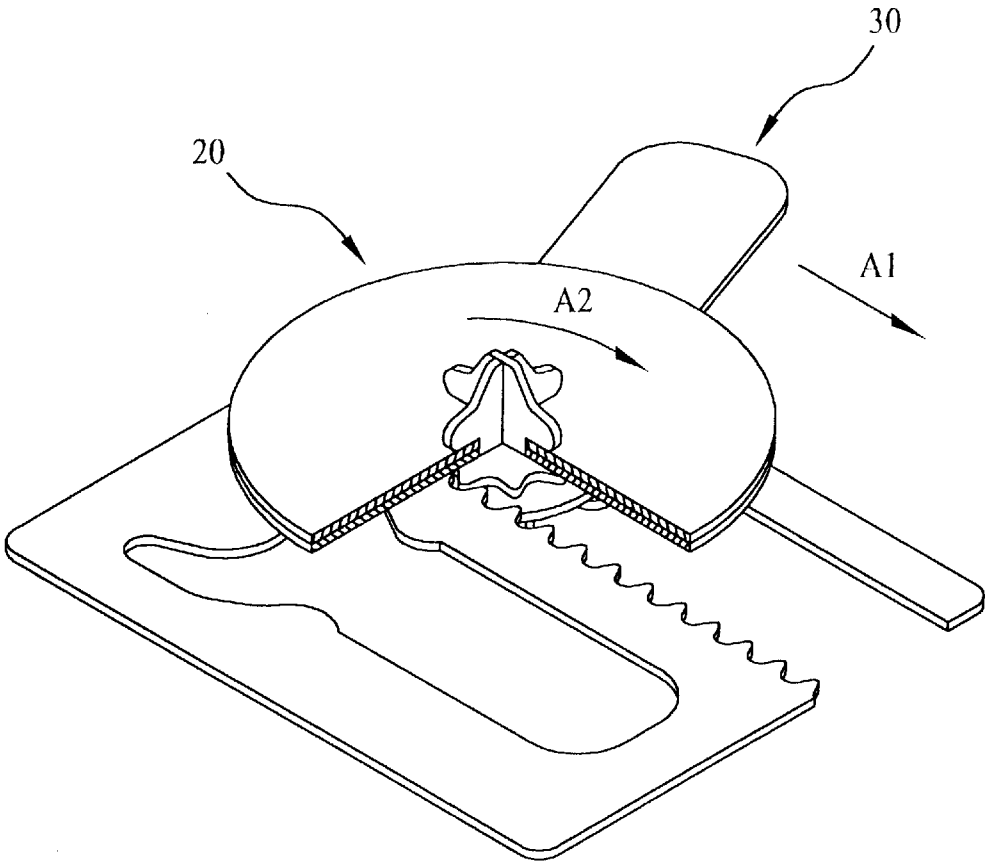
FIG. 3 is a perspective view showing the use of the built-up spinning top of FIG. 1, wherein a part of the turning wheel is cut away to show an internal structure thereof.

FIG. 3 is an assembled perspective view of the built-up spinning top of FIG. 1, wherein a part of the turning wheel 20 is cut away to show an internal structure thereof. Since the upper and the lower catch plates 25 and 27 are spaced from each other by a distance slightly larger than the thickness of the fixing plate 10, the turning wheel 20 can be connected to the fixing plate 10 at the long opening 11 with the tooth gear 23 meshing with the teeth 13 on the long opening 11 and the upper and the lower catch plates 25, 27 located above and below the fixing plate 10, respectively. The actuating handle 30 may be extended below the fixing plate 10 to engage the curved recess 31 with one side of the handle-engaging disc 26 at a lower part of the turning wheel 20, in order to move the turning wheel 20 outward along the long opening 11 in a direction indicated by the arrow A1. Meanwhile, the tooth gear 23 meshes with the teeth 13 to generate a force that causes the turning wheel 20 to turn in a direction indicated by the arrow A2 while moving forward a long the long opening 11. When the turning wheel 20 is moved beyond the open end of the long opening 11 to separate from the fixing plate 10, it keeps revolving on the supporting shaft 21 on a plane surface just like a general spinning top.

Figure 4:
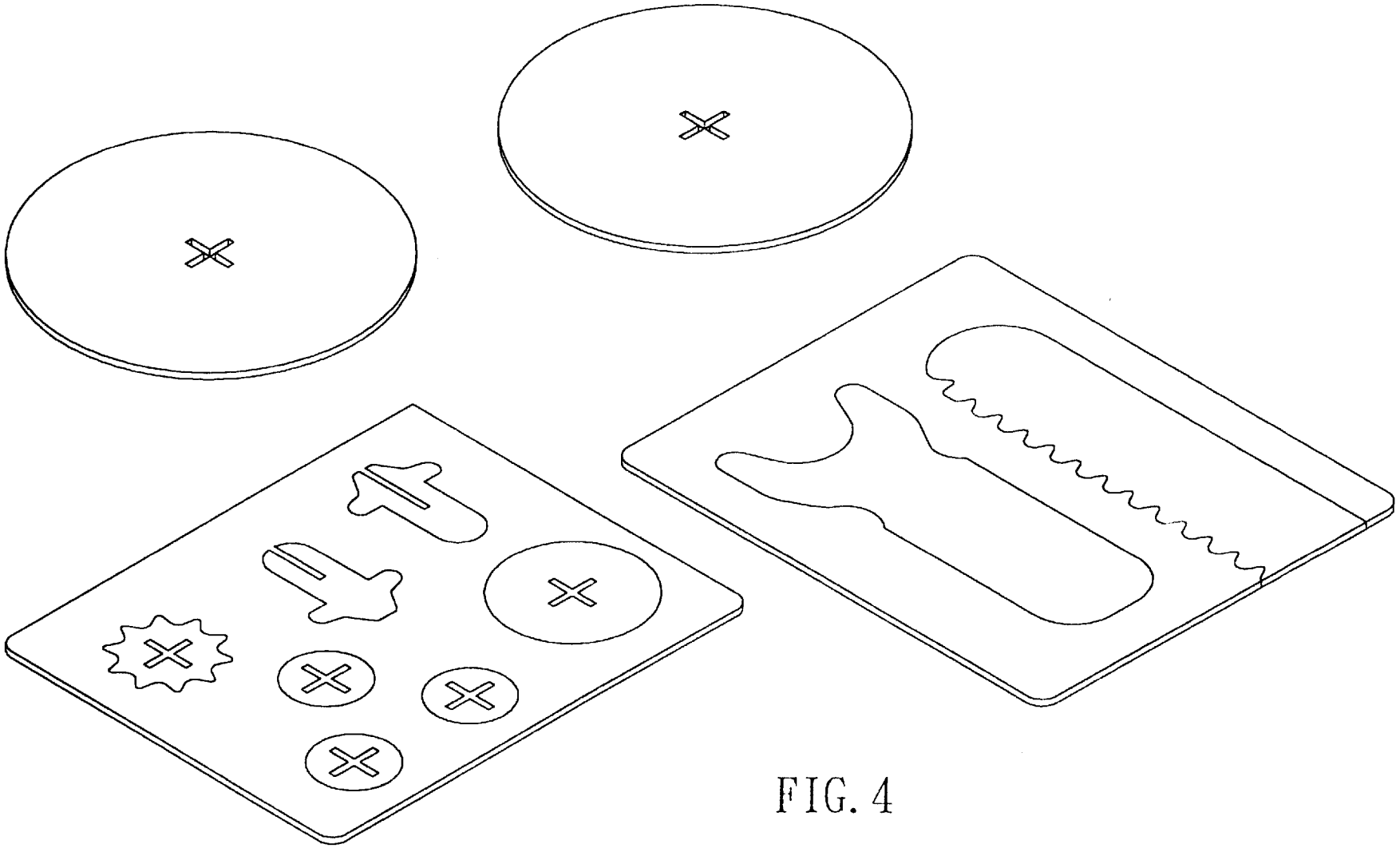
FIG. 4 shows all components of the built-up spinning top of the present invention are flat parts that are included in flat boards before being used to build up the spinning top.

Please refer to FIG. 4. All components for forming the built-up spinning top of the present invention are flat parts that are included in one or more flat boards before being used to build up the spinning top.

Figure 5:
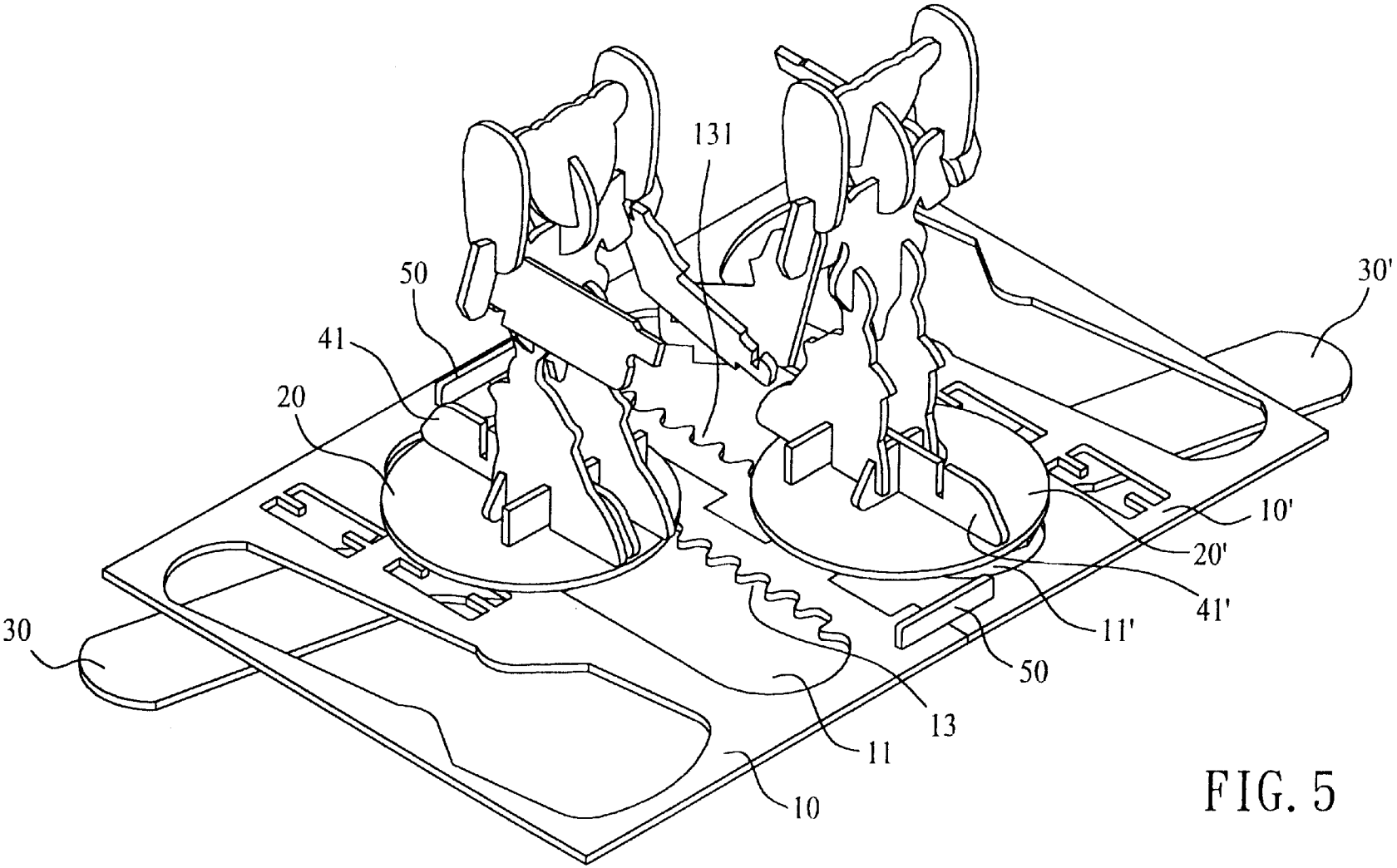
FIG. 5 is a perspective view of a built-up spinning top according to another embodiment of the present invention.

FIG. 5 shows another embodiment of the present invention. In this embodiment, two fixing plates 10 and 10' are connected together by means of connecting plates 50 to locate in one plane. The fixing plates 10 and 10' are provided with closed long openings 11 and 11', respectively. The closed long openings 11 and 11' are in parallel with each other, and are separately provided along their one longitudinal inner edge with one row of continuously arranged teeth 13, 13'. This embodiment includes turning wheels 20, 20' and actuating handles 30, 30 ' that are the same as that in the embodiment illustrated in FIGS. 1 and 2. However, the turning wheels 20, 20' are provided on tops of the upper catch plates thereof with seats 41, 41', respectively. Both the seats 41, 41' are formed from two, perpendicularly intersected flat plates for two built-up toys 40, 40', such as a doll, to connect thereto. The turning wheels 20, 20' are separately connected to the fixing plates 10, 10' at the closed long openings 11, 11' with tooth gears (not shown in FIG. 5) of the turning wheels 20, 20' meshing with the teeth 13, 13' provided in the closed long openings 11, 11'. The actuating handles 30, 30' may be extended below the fixing plates 10, 10' in different directions to detachably engage with one side of corresponding sub-discs (not shown in FIG. 5) , in order to move the turning wheels 20, 20' back and forth along the closed long openings 11, 11'. When being moved along the closed long openings 11, 11', the turning wheels 20, 20' are simultaneously caused to turn through meshing of the tooth gears with the teeth 13, 13', and the dolls 40, 40' connected to the tops of the turning wheels 20, 20' move at the same time in circular motion to create more fun. Alternatively, the dolls 40, 40' may be separately turned in different directions to play interesting fighting games as desired.

The present invention has been described with some embodiments thereof and it is understood that many changes and modifications in the described embodiments can be carried out without departing from the scope and the spirit of the invention as defined by the appended claims.

What is claimed is:

1. A built-up spinning top, comprising:

a fixing plate provided with a long opening having an open end, said long opening being provided along a longitudinal inner edge with a row of continuously arranged teeth;

a turning wheel including an axially extended supporting shaft, a tooth gear fixed to a position near a middle point of said supporting shaft, an upper and a lower catch plate connected to said supporting shaft to separately locate above and below said tooth gear with a space between said upper and lower catch plates slightly larger than a thickness of said fixing plate, and a handle-engaging disc formed from a plurality of laminated sub-discs and connected to said supporting shaft to locate below said lower catch plate; and an actuating handle having an end provided with a curved recess, said curved recess having openness slightly larger than said handle-engaging disc for freely detachably engaging with one side of said handle-engaging disc at any time;

said turning wheel being connected to said fixing plate at said long opening with said tooth gear meshing with said teeth provided in said long opening and said upper and said lower catch plates located above and,below said fixing plate, respectively;

said actuating handle being adapted to extend below said fixing plate to engage the end having said curved recess with one side of said handle-engaging disc of said turning wheel connected to said fixing plate at said long opening and thereby move said turning wheel back and forth along said long opening; and said turning wheel being moved along said long opening on said fixing plate turning at the same time due to meshing of said tooth gear with said teeth in said long opening, such that said turning wheel keeps revolving on said supporting shaft on a plane surface when it is moved by said actuating handle beyond said open end of said long opening to separate from said fixing plate.

2. The built-up spinning top as claimed in claim 1, wherein said upper and said lower catch plates are flat parts having a round shape.

3. A built-up spinning top, comprising:

a plurality of fixing plates connected together by means of connecting plates to locate in one plane, each of said plurality of fixing plates being provided with a closed long opening having a row of continuously arranged teeth provided along a longitudinal inner edges thereof, and said closed long openings formed on said plurality of fixing plates being in parallel with one another;

a plurality of turning wheels in a number corresponding to that of said fixing plates, each of said turning wheels including an axially extended supporting shaft, a tooth gear fixed to a position near a middle point of said supporting shaft, an upper and a lower catch plate connected to said supporting shaft to separately locate above and below said tooth gear with a space between them slightly larger than a thickness of said fixing plate, a handle-engaging disc formed from a plurality of laminated sub-discs and connected to said supporting shaft to locate below said lower catch plate, a seat formed from two perpendicularly intersected plates and connected to a top of said upper catch plate, and a doll connected to a top of said seat; and a plurality of actuating handles in a number corresponding to that of said turning wheels, each of said actuating handles having an end provided with a curved recess, said curved recess having openness slightly larger than said handle-engaging disc for freely detachably engaging with one side of said handle-engaging disc at any time;

said turning wheels being separately connected to said fixing plates at said long openings with said tooth gears meshing with said teeth in said closed long openings and said upper and said lower catch plates located above and below said fixing plates, respectively;

said actuating handles being adapted to extend below said fixing plates to engage the ends having said curved recess with one side of said laminated sub-discs of said turning wheels connected to said fixing plate at said long openings and thereby move said turning wheels back and forth along said closed long openings; and said turning wheels being moved along said closed long openings on said fixing plates turning at the same time due to meshing of said tooth gears with said teeth on said closed long openings, and bringing said dolls on said upper catch plates to move in circular motion simultaneously.

* * * * *